US005722492A

United States Patent [19]

Finn

[11] Patent Number: 5,722,492

[45] Date of Patent: Mar. 3, 1998

[54] CATENARY RISER SUPPORT

[75] Inventor: Lyle David Finn, Sugar Land, Tex.

[73] Assignee: Deep Oil Technology, Incorporated, Houston, Tex.

[21] Appl. No.: 701,622

[22] Filed: Aug. 22, 1996

[51] Int. Cl.[6] ..... E21B 17/01

[52] U.S. Cl. ..... 166/367; 405/224.2

[58] Field of Search ..... 166/367, 359, 166/350; 405/202, 224.2, 224.3

[56] References Cited

U.S. PATENT DOCUMENTS 4,188,156 2/1980 Fisher et al. ..... 405/224.3

4,240,506 12/1980 Dareing ..... 166/367

4,854,781 8/1989 Sparks et al. ..... 405/224.2

*Primary Examiner*—William P. Neuder

*Attorney, Agent, or Firm*—Robert J. Edwards; D. Neil LaHaye

[57] ABSTRACT

A catenary riser support tube that receives the riser and is attached to the floating offshore structure. The support tube is attached to the floating offshore structure at an angle from the vertical so as to be in line with the natural angle that the installed catenary riser would assume on a calm day. The support tube is attached to the floating offshore structure at different points along the length of the support tube and thus flexes about its attachment points to the floating structure. This minimizes stresses on the catenary riser.

3 Claims, 2 Drawing Sheets

CATENARY RISER SUPPORT

BACKGROUND OF THE INVENTION

1. Field of the Invention

The invention is generally related to the production of hydrocarbons from subsea formations and more particularly to the risers used in such production.

2. General Background

In producing hydrocarbons from subsea formations, it is common that a number of wells are drilled into the sea floor in positions that are not directly below or substantially within the outline of the structure used during production operations. The produced hydrocarbons are subsequently exported via subsea pipelines. This results in production and export risers that have a catenary curve in the risers between the structure and the sea floor. The movement of floating production platforms causes corresponding flex and stress in the risers. The current state of the art has accommodated the flex in the risers by incorporating ball joints at suitable locations in the joints between pipe segments in the riser. The ball joints present the problem of being more expensive and less reliable than pipe segments that are welded together.

SUMMARY OF THE INVENTION

The invention addresses the above need. What is provided is a catenary riser support tube that receives the riser and is attached to the floating offshore structure. The support tube is attached to the floating offshore structure at an angle from the vertical so as to be in line with the natural angle that the installed catenary riser would assume on a calm day. The support tube is attached to the floating offshore structure at different points along the length of the support tube and thus flexes about its attachment points to the floating structure. The support tube extends outward from the floating structure such that the first attachment point is located a distance from the lower end of the support tube. Additional flexibility in the support tube is attained by locating the second attachment point to the floating structure at a key distance further from the end of the support tube. The support tube may be provided with a bending stiffness that varies from the first attachment point to the lower end of the support tube.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
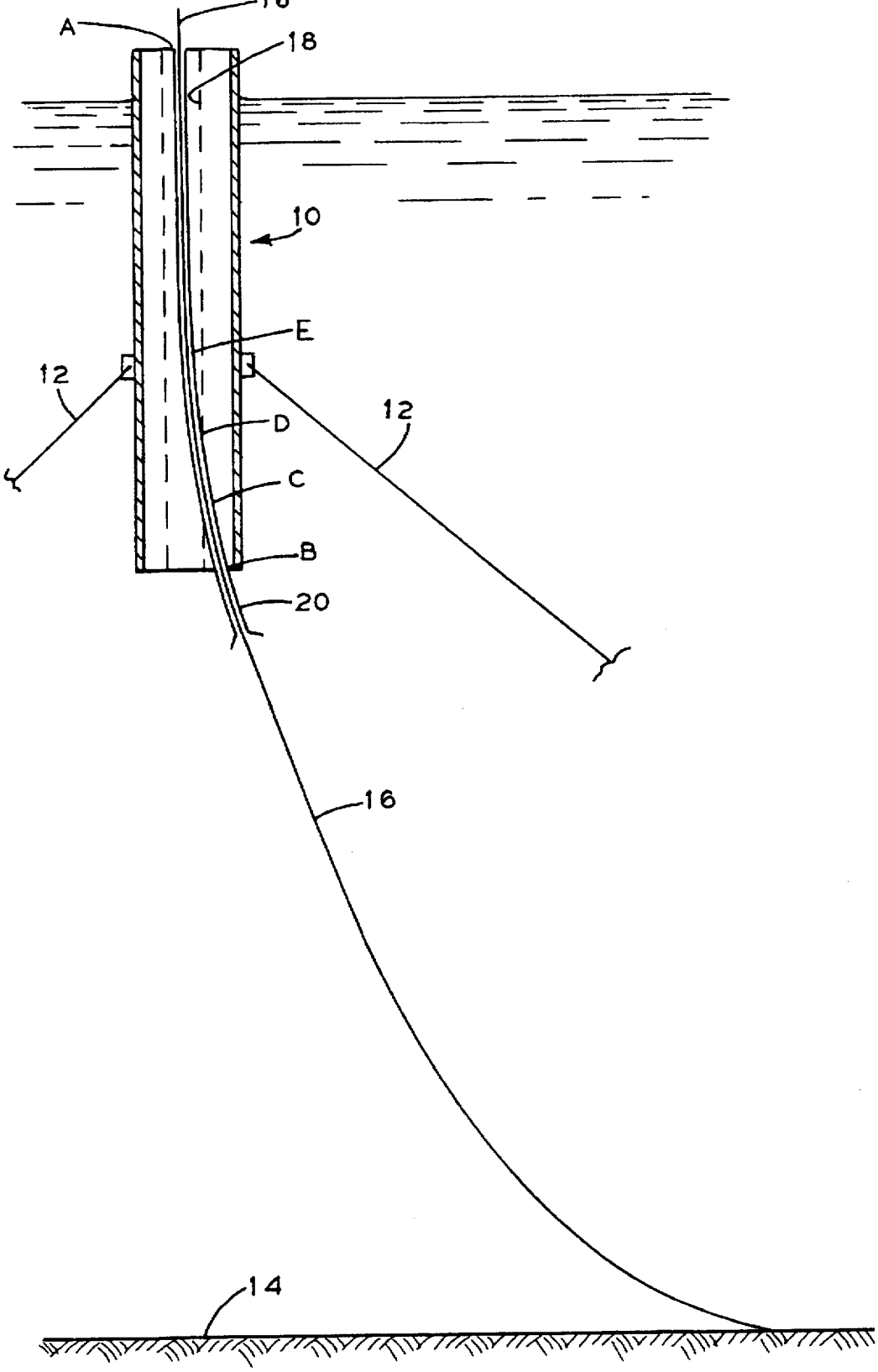
FIG. 1 is a side sectional schematic view that illustrates the invention on a floating offshore structure.

In FIG. 1, a floating offshore structure 10 is held in position by a plurality of mooring lines 12. The mooring lines 12 are attached at one end to the floating structure 10 and at the opposite end to anchors or pilings not shown in the sea floor 14. Catenary riser 16 extends from the sea floor 14 up to and through a center well 18 provided in the floating structure 10 to production facilities not shown. Support for the catenary riser is provided in the form of support tube 20.

Support tube 20 has an internal diameter sized to receive the catenary riser 16 therethrough. Support tube 20 is attached at its upper end to the floating structure 10, indicated by A, at a slight angle from the vertical so as to be in line with the natural angle that the catenary riser 16 assumes when in its installed position in calm seas. The support tube 20 has a length that extends outboard the lower end of the floating structure 10 and is attached to the lower end of the floating structure 10, indicated by B, and at predetermined points indicated by letters C,D, and E. The number and location of the attachment points between the support tube 20 and the floating structure 10 is determined by the flexibility desired in the support tube 20. For example, greater flexibility toward the lower end of the support tube 20 may be achieved by moving attachment point C further away from attachment point B at the lower end of the floating structure 10. Allowing the support tube 20 to flex about its attachment points to the floating structure 10 maintains the stresses on the catenary riser 16 within allowable limits.

The support tube 20 can be provided with progressively greater flexibility from attachment point B to its lower end such as by varying the wall thickness and/or diameter of the tube.

Figure 2:
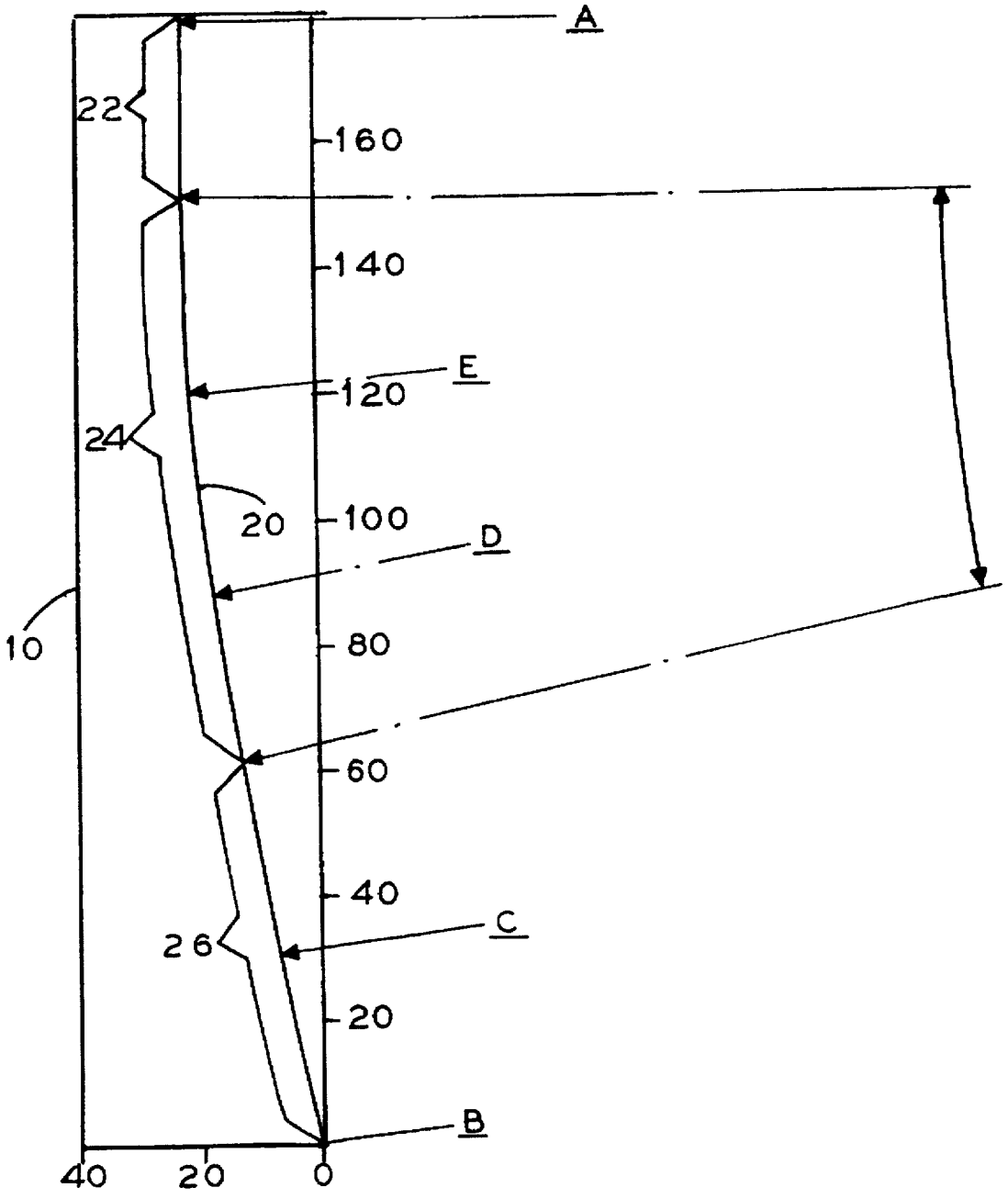
FIG. 2 schematically illustrates the shape of one embodiment of the support tube of the invention.

As seen in FIG. 2, the support tube 20 may be constructed with a combination of curved and straight sections incorporated into its shape such that the upper end of the support tube is substantially vertical and directs the catenary riser to a desired above water location on the floating structure in a substantially vertical orientation. In this example of an embodiment of the invention, section 22 of support tube 20 is straight, section 24 is curved, and section 26 is straight. The floating structure 10 is one hundred eighty feet tall. Section 22 of the support tube is thirty feet long, section 24 is ninety feet long, and section 26 is sixty feet long. Section 24 has a radius of four hundred thirty-two feet, which results in an exit angle of twelve degrees at the bottom of the floating structure 10 to accommodate the natural catenary curve of the riser 16. It should be understood that FIG. 2 is used merely as an illustration of one possible configuration of the invention and that the entire length of the support tube 20 below floating structure 10 is not shown.

Three different procedures may be used to install the catenary riser 16 in the support tube 20.

In the pre-lay method, the riser pipe is placed on the sea floor 14 prior to the floating structure 10 being moored at the site. Once the floating structure 10 is secured in position, the end of the riser 16 is positioned at the bottom end of the support tube 20 and pulled through to a point where the end of the riser 16 is above the water. During the pull-in phase, the angle of the riser 16 and the support tube 20 would assume angles other than the natural catenary neutral (no bending stress) position. During the initial phase of the pull-in, the angle would be less than the desired neutral position. At the end of the pull-in phase, the exit angle could be equal to the desired neutral position or could be larger than the neutral angle. If the exit angle is larger than the desired neutral position once the end of the riser 16 reached the surface, additional sections of riser pipe would be added. The upper end of the now longer riser is lowered, adding segments as needed,until the desired calm day neutral angle is achieved at the exit point from the support tube 20. Additional adjustments to the exit angle could be achieved by moving the floating structure 10 horizontally at the surface. It would also be possible with some floating structures to tilt the structure, and the attached support tube 20, using ballast and thus more accurately accommodate the neutral riser catenary angle at the entrance point to the support tube during installation.

In the lay-to method, the riser installation vessel, not shown, would approach the floating structure 10 as the installation vessel lays riser pipe on the sea floor. The end of the riser 16 would be lowered with cables from the installation vessel until the riser is at the entrance point to the support tube 20. A cable threaded through the support tube would then be used to pull the riser 16 through the support tube to a point above the water surface. The installation would then be completed as described above.

In the lay-away method, the riser 16 would be pulled from the riser installation vessel by a cable threaded through the support tube 20. The appropriate length of riser pipe is suspended between the riser pipe installation vessel and the outside floating structure 10 to maintain the desired neutral entrance angle at the entrance point to the support tube 20. With this method, it would not be necessary to add segments of riser pipe at the end of the riser pipe at the floating structure 10.

The invention eliminates the need for expensive subsea flex joints and riser pipe connectors. With the pre-lay method, the riser pipe can be installed immediately after the floating structure is positioned and thus would be ready for use immediately. This could allow for oil and gas production to come on stream sooner. Also, the all welded pipe is generally considered to be more reliable than pipelines with mechanical connections and flex joint elements.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a floating offshore structure for producing hydrocarbons where a catenary riser extends from the sea floor to the floating structure, a support for the catenary riser, said support comprising a tube attached at predetermined locations to the floating offshore structure such that said support tube exits the lower end of the floating structure at an angle from the vertical, said tube extending outboard the lower end of the floating offshore structure and being sized to receive the catenary riser through said tube, wherein the portion of said tube that extends outboard the lower end of the floating offshore structure has progressively increased flexibility toward the lower end of said support tube.

2. The support tube of claim 1, wherein the portion of said tube that extends outboard the lower end of the floating offshore structure is curved to substantially match the natural curve of the catenary riser received therein.

3. In a floating offshore structure for producing hydrocarbons where a catenary riser extends from the sea floor to the floating structure, a support for the catenary riser, said support comprising a tube attached at predetermined locations to the floating offshore structure such that said support tube exits the lower end of the floating structure at an angle from the vertical, said tube extending outboard the lower end of the floating offshore structure and being sized to receive the catenary riser through said tube, wherein said support tube is formed from a combination of curved sections and straight sections such that the upper end of said support tube is substantially vertical and the lower end of said support tube substantially matches the normal installed angle of the catenary riser in calm seas.

* * * * *